US012736248B2

(12) United States Patent
Ma et al.

(10) Patent No.: US 12,736,248 B2
(45) Date of Patent: Sep. 15, 2026

(54) AIR CONDITIONER, FOUR-WAY VALVE ABNORMAL DIRECTION CHANGE DETECTION METHOD AND DEFROSTING CONTROL METHOD

(71) Applicant: ZHUZHOU MEGMEET ELECTRIC CO., LTD., Hunan (CN)

(72) Inventors: Zan Ma, Hunan (CN); Pintong Lu, Hunan (CN); Long Huang, Hunan (CN); Jian Wang, Hunan (CN); Shenfei Du, Hunan (CN); Chao Yang, Hunan (CN)

(73) Assignee: ZHUZHOU MEGMEET ELECTRIC CO., LTD., Hunan (CN)

( * ) Notice: Subject to any disclaimer, the term of this patent is extended or adjusted under 35 U.S.C. 154(b) by 68 days.

(21) Appl. No.: 19/063,222

(22) Filed: Feb. 25, 2025

(65) Prior Publication Data

US 2025/0283629 A1 Sep. 11, 2025

(30) Foreign Application Priority Data

Mar. 6, 2024 (CN) ..... 202410257845.2

(51) Int. Cl.

| | |
|---|---|
| ***F25B 49/02*** | (2006.01) |
| ***F24F 11/72*** | (2018.01) |
| ***F25B 41/20*** | (2021.01) |
| *F24F 110/20* | (2018.01) |

(52) U.S. Cl.

CPC ..... *F24F 11/72* (2018.01); *F25B 41/20* (2021.01); *F25B 49/02* (2013.01); *F24F 2110/20* (2018.01); *F25B 2600/25* (2013.01)

(58) Field of Classification Search

CPC . F24F 11/72; F25B 49/02; F25B 41/20; F25B 2110/20; F25B 2600/25

See application file for complete search history.

(56) References Cited

FOREIGN PATENT DOCUMENTS

| | | | | |
|---|---|---|---|---|
| CN | 109186154 B | * | 4/2020 | ..... F25B 49/02 |
| CN | 116697651 A | * | 9/2023 | ..... F25B 49/02 |

OTHER PUBLICATIONS

FOR1, Four-way Valve Collaboration Protection Fault Diagnostic Method, Device, Storage Medium And Air Conditioning, 2020, Full Document (Year: 2020).*

FOR2, Method and Device for Determining Abnormality of Four-way Valve of Refrigerating Unit, 2023 Full Document (Year: 2023).*

* cited by examiner

*Primary Examiner* — Nael N Babaa

(74) *Attorney, Agent, or Firm* — BAYES PLLC

(57) ABSTRACT

An air conditioner, a four-way valve abnormal direction change detection method and a defrosting control method, are provided. The detection method includes obtaining a heat exchanger temperature and an ambient temperature; determining whether the heat exchanger temperature and the ambient temperature meet a first preset condition; when the heat exchanger temperature and the ambient temperature meet the first preset condition, the four-way valve is normal in direction change; when the heat exchanger temperature and the ambient temperature do not meet the first preset condition, obtaining the work power of the air conditioner and determining whether the work power meets a second preset condition; and when the work power meets the second preset condition, the four-way valve is abnormal in direction change; otherwise, the four-way valve is normal in direction change.

10 Claims, 7 Drawing Sheets

AIR CONDITIONER, FOUR-WAY VALVE ABNORMAL DIRECTION CHANGE DETECTION METHOD AND DEFROSTING CONTROL METHOD

CROSS-REFERENCE TO RELATED APPLICATION

The present application claims the benefit of priority to Chinese Patent Application No. 202410257845.2, filed on Mar. 6, 2024, which is hereby incorporated by reference in its entirety.

TECHNICAL FIELD

The embodiments of this application relate to an air conditioner defrosting control technology field, and more particularly, to an air conditioner, a four-way valve abnormal direction change detection method and a defrosting control method.

TECHNICAL BACKGROUND

In a heating mode of the air conditioner, an outdoor heat exchanger is prone to frosting. Severe frosting will affect the heating effect. Therefore, the outdoor heat exchanger of the air conditioner should be regularly defrosted. Where, the defrosting of the outdoor heat exchanger is realized by switching between the heating mode and the cooling mode with the four-way valve by changing the direction. However, sometimes, the direction may not be changed successfully. When the four-way valve is abnormal in direction change, it is unable to defrost.

SUMMARY

The embodiments of this application relate to an air conditioner, a four-way valve abnormal direction change detection method and a defrosting control method to detect whether the four-way valve is successful in direction change, solve the problem of abnormal direction change and improve the successful rate of defrosting.

To solve above technical problems, the technical scheme in this application is to provide a four-way valve abnormal direction change detection method for an air conditioner. The detection method includes that obtain a heat exchanger temperature and an ambient temperature; determine whether the heat exchanger temperature and the ambient temperature meet a first preset condition; if the heat exchanger temperature and the ambient temperature meet the first preset condition, the four-way valve is normal in direction change; if the heat exchanger temperature and the ambient temperature don't meet the first preset condition, obtain the work power of the air conditioner and determine whether the work power meets a second preset condition; if the work power meets the second preset condition, the four-way valve is abnormal in direction change; otherwise, the four-way valve is normal in direction change.

In some embodiments, the steps of obtaining a heat exchanger temperature and an ambient temperature and determining whether the heat exchanger temperature and the ambient temperature meet the first preset condition include controlling the air conditioner in a first state with a control device; after the air conditioner operates for a first duration in the first state, obtaining a first heat exchanger temperature and a first ambient temperature and calculate a first temperature difference between the first heat exchanger temperature and the first ambient temperature; after the air conditioner operates for a second duration in the first state, obtaining a second heat exchanger temperature and a second ambient temperature and calculate a second temperature difference between the second heat exchanger temperature and the second ambient temperature; the first preset condition is that the difference between the first temperature difference and the second temperature difference is not less than a preset temperature difference.

In some embodiments, the step of obtaining the heat exchanger temperature and the ambient temperature includes obtaining an outdoor heat exchanger temperature and an outdoor ambient temperature; or obtaining an indoor heat exchanger temperature and an indoor ambient temperature.

In some embodiments, the step of determining whether the work power meets the second preset condition includes that the second preset condition is that the difference between the work power and a normal rated power is greater than a preset value; where, the normal rated power is the power when the four-way valve is normal in direction change.

In some embodiments, the preset temperature difference ranges from 8° C. to 18° C.; the preset value ranges from 15% to 25% of the normal rated power.

To solve above technical problems, another technical scheme in this application is to provide a defrosting control method for the air conditioner. The defrosting control method includes that control the four-way valve to change the direction with the control device to switch the air conditioner to a cooling state; detect whether the four-way valve is abnormal in direction change, where, the detection method is one mentioned above; if the four-way valve is normal in direction change, control the air conditioner to continuously defrost with the control device; if the four-way valve is abnormal in direction change, execute the step of controlling the four-way valve to change the direction with a control device to switch the air conditioner to a cooling state.

In some embodiments, if the four-way valve is abnormal in direction change, the step of controlling the four-way valve to change the direction with the control device to switch the air conditioner to a cooling state includes that: if the four-way valve is abnormal in direction change, determine whether the number of times of changing direction with the four-way valve is less than a preset number of times; if the number of times of changing direction with the four-way valve is less than the preset number of times, execute the step of controlling the four-way valve to change the direction with the control device to switch the air conditioner to a cooling state. On the contrary, alarm for abnormality.

In some embodiments, the preset number of times is 3.

To solve above technical problems, another technical scheme in this application is to provide an air conditioner. The air conditioner defrosts under the control by the defrosting control method mentioned above.

In some embodiments, the air conditioner includes a compressor, an indoor heat exchanger, an outdoor heat exchanger, a four-way valve and a throttle valve; the compressor includes an air outlet and an air inlet; the four-way valve includes a first flow channel and a second flow channel; the four-way valve is configured to switch the connection state to ensure that in a heating mode, the air outlet of the compressor, the first flow channel of the four-way valve, the indoor heat exchanger, the throttle valve, the outdoor heat exchanger, the second flow channel of the four-way valve and the air inlet of the compressor are connected in sequence to form a heating loop; in a cooling mode, the air outlet of the compressor, the second flow channel of the four-way valve, the outdoor heat exchanger, the throttle valve, the indoor heat exchanger, the first flow channel of the four-way valve, and the air inlet of the compressor are connected in sequence to form a cooling loop.

The beneficial effects of this application are that: different from the related art, the embodiments of this application relate to an air conditioner, a four-way valve abnormal direction change detection method and a defrosting control method. The detection method includes that obtain the heat exchanger temperature and the ambient temperature; determine whether the heat exchanger temperature and the ambient temperature meet the first preset condition; if the heat exchanger temperature and the ambient temperature meet the first preset condition, the four-way valve is normal in direction change; if the heat exchanger temperature and the ambient temperature don't meet the first preset condition, obtain the work power of the air conditioner and determine whether the work power meets the second preset condition; if the work power meets the second preset condition, the four-way valve is abnormal in direction change; otherwise, the four-way valve is normal in direction change. The embodiments of this application detect and determine whether the four-way valve is abnormal in direction change by change rate of the heat exchanger temperature and the ambient temperature and power comparison to make the four-way valve abnormal direction change detection more accurate. When the four-way valve is abnormal in direction change, handle it in time so as to improve the probability of successful direction change of the four-way valve and the successful rate of defrosting.

BRIEF DESCRIPTION OF DRAWINGS

To provide an explanation of the technical schemes in some embodiments of this application, a brief introduction will be given to the drawings required in the description of the embodiments. The drawings in the following description are only some embodiments of the application. The persons skilled in the art can obtain other drawings based on these drawings without putting in creative labor.

DESCRIPTION OF REFERENCE NUMERALS

11—four—way valve; 12—compressor; 13—outdoor heat exchanger;
14—indoor heat exchanger; 15—throttle valve.

DETAILED DESCRIPTION

To make objectives, technical solutions, and advantages of the present disclosure clearer, embodiments of the present disclosure are described in further detail below with reference to the drawings.

The terms in the embodiments of this application are only provided for the purpose of describing the specific embodiments, instead of limiting this application. The singular forms of "one", "the", and "this" in the embodiments and the claims of this application are also intended to include the majority forms, unless otherwise clearly stated above. In general, the term "a plurality of" means two or more, but it is not ruled out that there may be at least one.

It should be understood that the term "and/or" in this application is only for describing the association relationships of associated objects and represents three relationships. For example, A and/or B represents three cases, i.e. existence of only A, existence of both A and B, and existence of only B. In addition, the symbol "/" generally represents the "or" relationship between the associated objects.

It should be understood that the terms "include", "comprise" or any other variants are intended to encompass non-exclusive inclusion, so that the processes, methods, articles or devices which include a series of elements don't only include those elements, but also include other elements not explicitly listed, or include the inherent elements of these processes, methods, articles or devices. Without further restrictions, the element limited by "include . . . " does not exclude other same elements in the processes, methods, articles or devices of the elements.

The defrosting of the outdoor heat exchanger is realized by switching between a heating mode and a cooling mode with the four-way valve by changing the direction. When the four-way valve is abnormal in direction change, it is unable to defrost.

Based on the above problem, the embodiments of this application relate to an air conditioner, a four-way valve abnormal direction change detection method and a defrosting control method to detect whether the four-way valve is successful in direction change, solve the problem of abnormal direction change and improve the successful rate of defrosting.

The following content is a detailed description of an air conditioner, a four-way valve abnormal direction change detection method and a defrosting control method provided in this application combined with drawings and embodiments.

Figure 1:
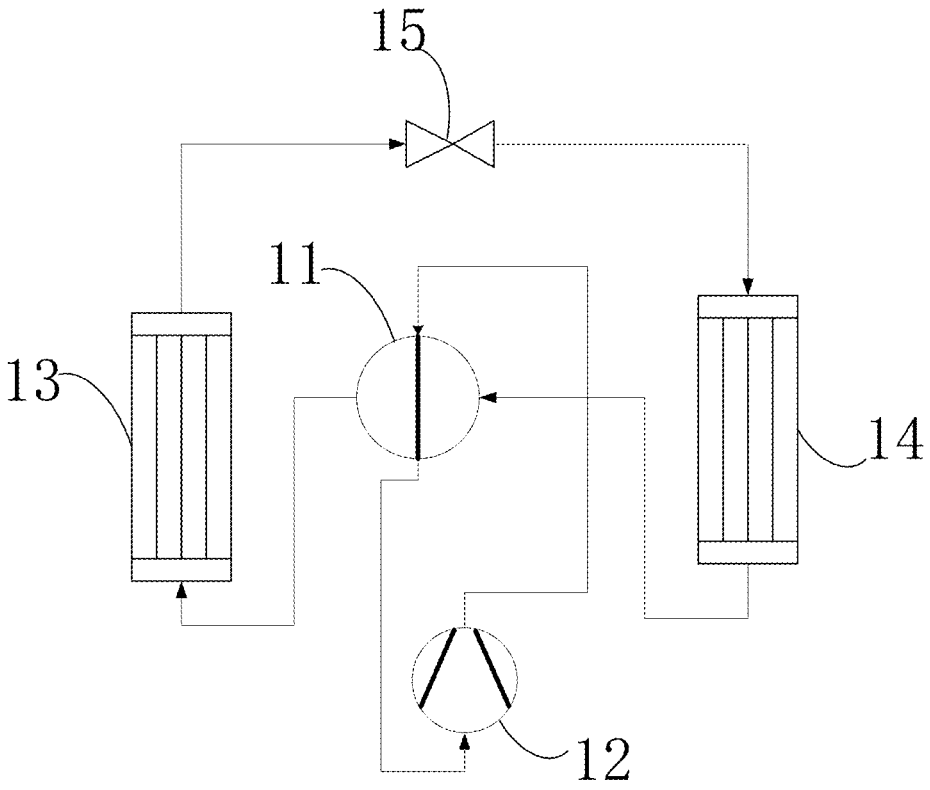
FIG. 1 illustrates a schematic diagram of a flow of refrigerant within the air conditioner in a cooling mode, according to some implementations of the present disclosure.

The embodiments of this application relate to a four-way valve abnormal direction change detection method for the air conditioner to detect the abnormality of the four-way valve of the air conditioner in direction change and to detect the abnormality of the four-way valve in direction change in switching between a heating mode and a cooling mode. Referring to FIG. 1, FIG. 1 illustrates a schematic diagram illustrating a flow of refrigerant within the air conditioner in a cooling mode, according to some embodiments of the present disclosure. In an embodiment, the air conditioner includes a four-way valve 11, a compressor 12, a throttle valve 15, an outdoor heat exchanger 13, and an indoor heat exchanger 14.

The compressor 12 compresses low-temperature and low-pressure gaseous refrigerant to form high-temperature and high-pressure gaseous refrigerant. The four-way valve 11 switches the state to change the flow direction of the refrigerant and plays the role of switching cooling and heating modes in the air conditioner. In a cooling mode, the four-way valve 11 makes the refrigerant flow towards the outdoor heat exchanger 13. In a heating mode, the four-way valve 11 changes the internal connection state to make the refrigerant firstly flow through the indoor heat exchanger 14 and then flow towards the outdoor heat exchanger 13.

Referring to FIG. 1, FIG. 1 illustrates a schematic diagram showing a flow of refrigerant within the air conditioner in a cooling mode, according to some embodiments of the present disclosure.

In a cooling mode, the refrigerant circulates and flows in the following sequence: compressor 12 (air outlet)→four-way valve 11 (towards the outdoor heat exchanger)→outdoor heat exchanger 13→throttle valve 15→indoor heat exchanger 14→four-way valve 11 (towards indoor heat exchanger)→compressor 12 (air inlet). The compressor 12 changes the low-temperature and low-pressure gaseous refrigerant to the high-temperature and high-pressure gaseous refrigerant; the process of the high-temperature and high-pressure refrigerant flowing from the compressor 12 to the four-way valve 11 is the exhaust process of the compressor 12. In a cooling mode, the high-temperature and high-pressure gaseous refrigerant firstly flows to the outdoor heat exchanger 13, is cooled in the outdoor heat exchanger 13 by heat exchange with external environment and releases the heat to form the medium-temperature and high-pressure liquid refrigerant; the medium-temperature and high-pressure liquid refrigerant from the outdoor heat exchanger 13 flows through the throttle valve 15 and partially evaporates and absorbs heat due to sudden drop of the pressure to form low-temperature and low-pressure gas-liquid mixture; the gas-liquid mixture flows to the indoor heat exchanger 14, exchanges heat with the indoor air, absorbs the indoor heat and evaporates to form low-temperature and low-pressure gaseous refrigerant, thus achieving the goal of reducing indoor temperature. In a cooling mode, refrigerant flows in a high-temperature and high-pressure state from the compressor 12 to the four-way valve 11, from the four-way valve 11 to the outdoor heat exchanger 13, and from the outdoor heat exchanger 13 to the throttle valve 15. Refrigerant flows in a low-temperature and low-pressure state from the throttle valve 15 to the indoor heat exchanger 14, from the indoor heat exchanger 14 to the four-way valve 11, and from the four-way valve 11 to the compressor 12. The process of low-temperature and low-pressure refrigerant flowing from the four-way valve 11 to the compressor 12 is the intake process of the compressor 12. Where, in a cooling mode, refrigerant in the outdoor heat exchanger 13 flows in a high-temperature and high-pressure state to realize defrosting of the outdoor heat exchanger 13.

Figure 2:
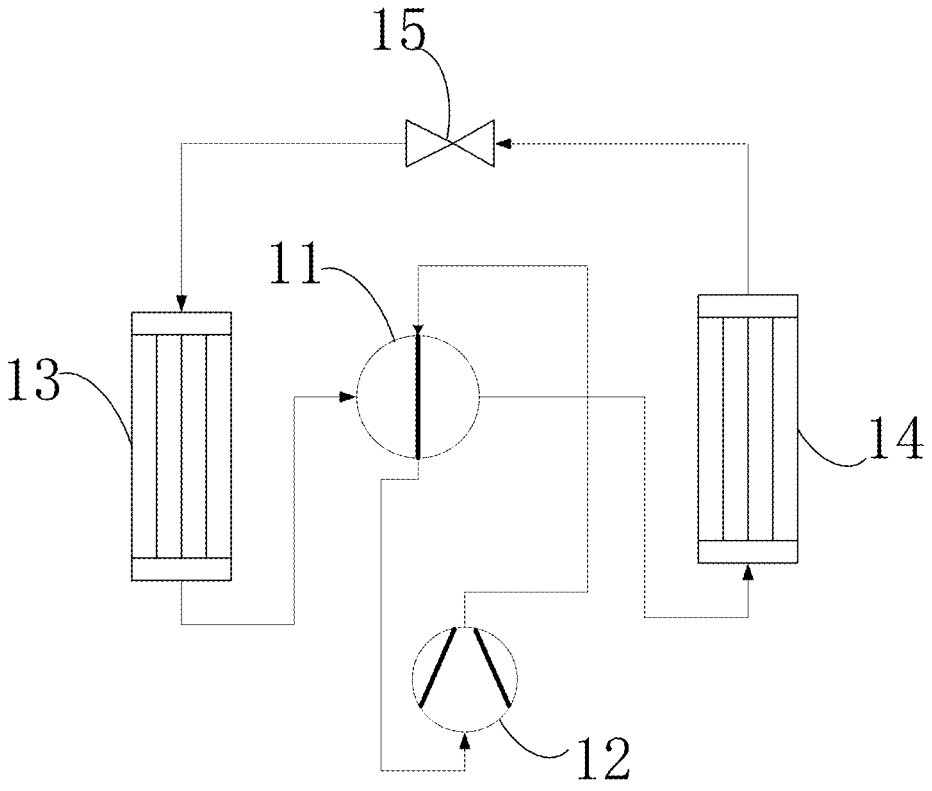
FIG. 2 illustrates a schematic diagram of a flow of refrigerant within the air conditioner in a heating mode, according to some implementations of the present disclosure.

Referring to FIG. 2, FIG. 2 illustrates a schematic diagram showing a flow of refrigerant within the air conditioner in a heating mode, according to some implementations of the present disclosure.

In a heating mode, the four-way valve 11 changes direction to make the refrigerant circulate and flow in the following sequence: compressor 12 (air outlet)→four-way valve 11 (indoor heat exchanger flow channel)→indoor heat exchanger 14→throttle valve 15→outdoor heat exchanger 13→four-way valve 11 (outdoor heat exchanger flow channel)→compressor 12 (air inlet). In a heating mode, refrigerant flows in a high-temperature and high-pressure state from the compressor 12 to the four-way valve 11, from the four-way valve 11 to the indoor heat exchanger 14 and from the indoor heat exchanger 14 to the throttle valve 15. Refrigerant flows in a low-temperature and low-pressure state from the throttle valve 15 to the outdoor heat exchanger 13, from the outdoor heat exchanger 13 to the four-way valve 11 and from the four-way valve 11 to the compressor 12. In a heating mode, the high-temperature and high-pressure refrigerant in the indoor heat exchanger 14 releases the heat to the indoor air to achieve the heating purpose.

As mentioned above, in a heating mode, refrigerant in the outdoor heat exchanger 13 flows in a low-temperature and low-pressure state. The external surface of the outdoor heat exchanger 13 is prone to frost condensation. The air conditioner is switched to a cooling mode by controlling the four-way valve 11 to change the direction. Refrigerant in the outdoor heat exchanger 13 flows in a high-temperature and high-pressure state so as to achieve the defrosting purpose. As mentioned above, if the four-way valve 11 is abnormal in direction change, defrosting may not be successful.

To improve the successful rate of defrosting, the embodiments of this application relate to a four-way valve abnormal direction change detection method to handle in time when the four-way valve is abnormal in direction change.

Figure 3:
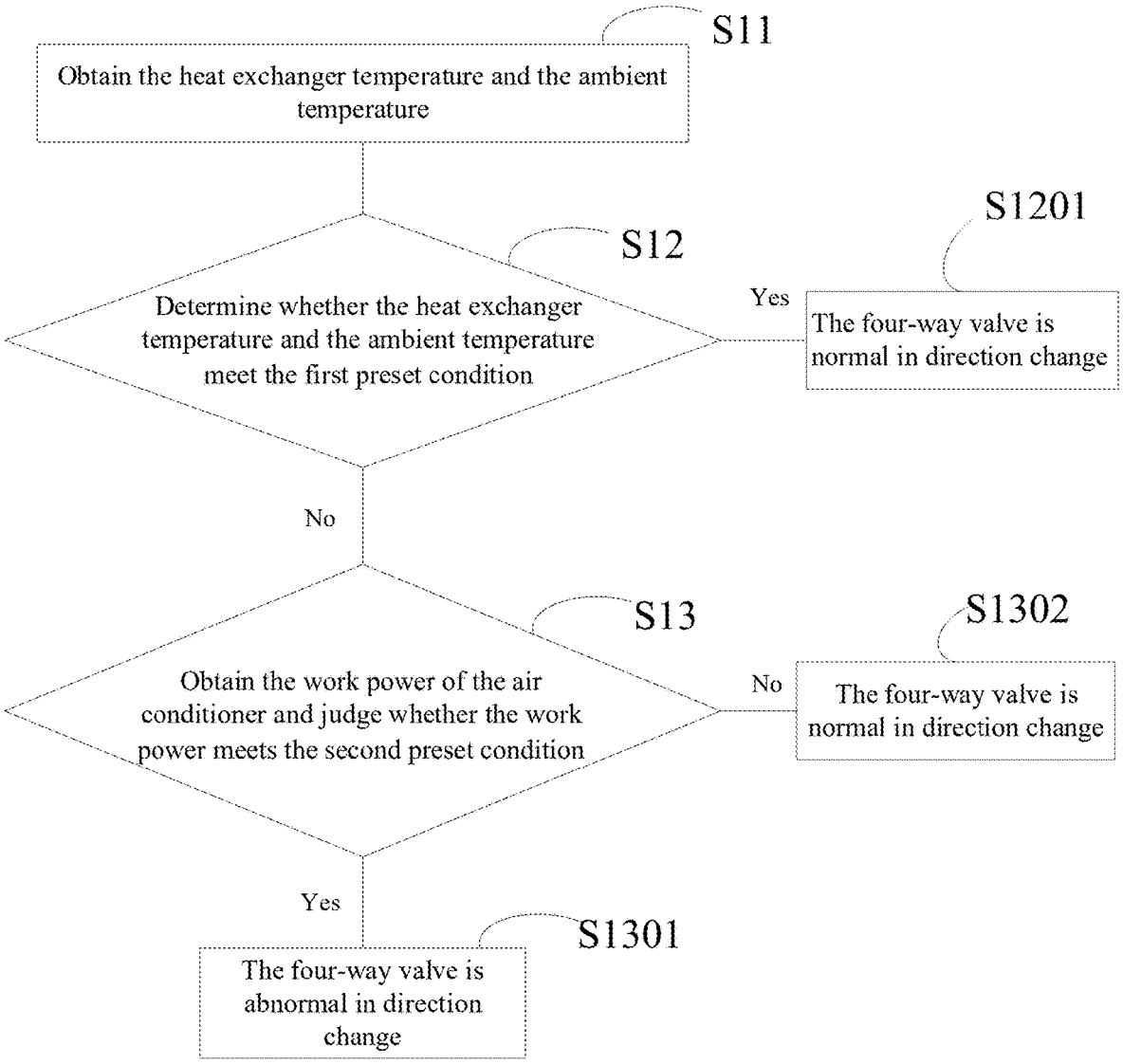
FIG. 3 illustrates a flowchart of the four-way valve abnormal direction change detection method, according to some implementations of the present disclosure.

Referring to FIG. 3, FIG. 3 illustrates a flowchart of the four-way valve abnormal direction change detection method, according to some implementations of the present disclosure. This method is for detecting abnormality of the four-way valve in direction change when the outdoor heat exchanger is in defrosting. In an embodiment, the method includes that:

S11: obtain the heat exchanger temperature and the ambient temperature.

To defrost, the four-way valve changes the direction and the air conditioner is switched to a cooling mode from a heating mode. Obtaining the heat exchanger temperature and the ambient temperature may occur after the four-way valve changes the direction. In some embodiments, obtaining the heat exchanger temperature and the ambient temperature may be obtaining the outdoor heat exchanger temperature and the outdoor ambient temperature.

In some embodiments, before the four-way valve changes the direction, the air conditioner is in a heating mode, and after the four-way valve changes the direction successfully, the air conditioner is in a cooling mode. If the four-way valve is abnormal in direction change, the air conditioner is unable to cool or the cooling effect is poor.

S12: determine whether the heat exchanger temperature and the ambient temperature meet the first preset condition.

Where, if meet, execute S1201; if don't meet, execute S13.

After obtaining the heat exchanger temperature and the ambient temperature, preliminarily determine whether the four-way valve is abnormal in direction change based on the heat exchanger temperature and the ambient temperature. For example, after controlling the four-way valve to change the direction, obtain the heat exchanger temperature and the ambient temperature after the air conditioner operates for a certain period. Preliminarily determine whether the four-way valve is abnormal in direction change based on temperature absolute value between the heat exchanger temperature and the ambient temperature.

S1201: the four-way valve is normal in direction change.

Figure 4:
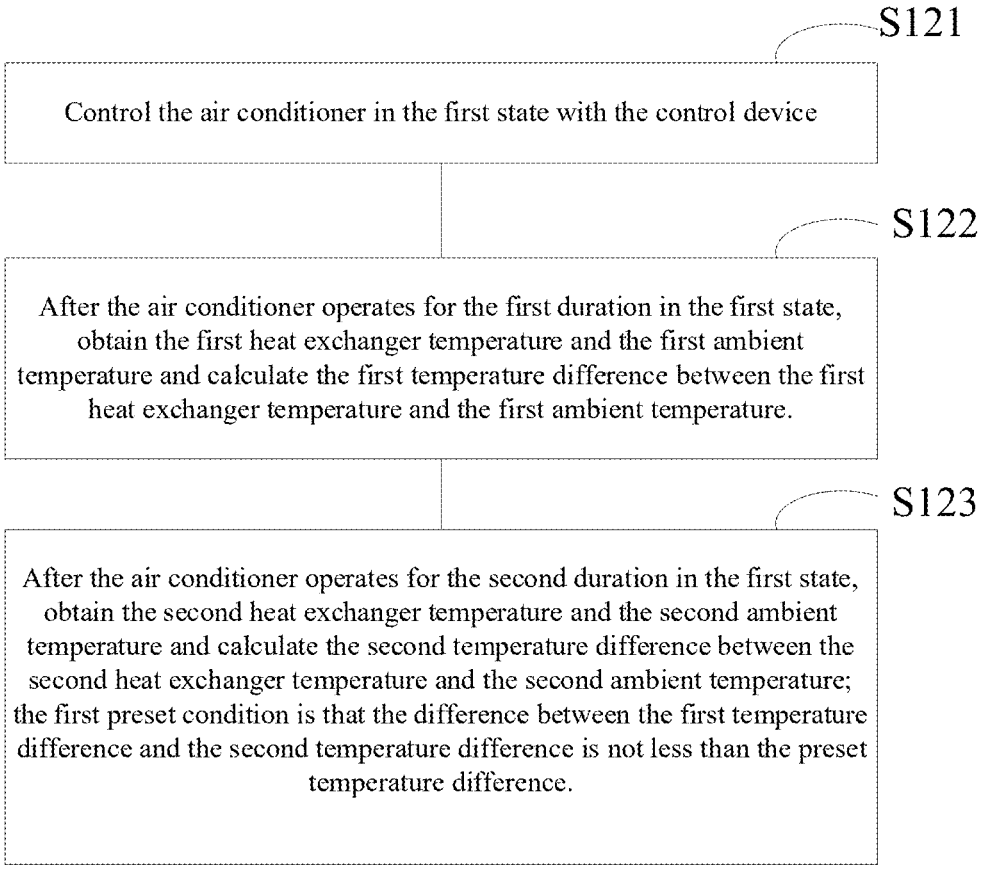
FIG. 4 illustrates a flowchart of the step S12 in FIG. 3, according to some implementations of the present disclosure.

Referring to FIG. 4, FIG. 4 illustrates a flowchart of the step S12 in FIG. 3, according to some implementations of the present disclosure. In some embodiments, S12 may include that:

S121: control the air conditioner in the first state with a control device;

After controlling the four-way valve to change the direction, the air conditioner enters a cooling mode, and the first state is that the air conditioner is in a cooling state and the compressor of the air conditioner operates with a certain frequency.

S122: after the air conditioner operates for the first duration in the first state, obtain the first heat exchanger temperature and the first ambient temperature and calculate the first temperature difference between the first heat exchanger temperature and the first ambient temperature.

The first duration may be any reasonable time value. In some embodiments, the first duration may be zero, i.e., obtaining the first heat exchanger temperature and the first ambient temperature may occur immediately after controlling the four-way valve to change the direction. In some embodiments, the heat exchanger temperature refers to the outdoor heat exchanger temperature. The ambient temperature refers to the outdoor ambient temperature. After the air conditioner operates for the first duration in the first state, obtain the first heat exchanger temperature TP1 and the first ambient temperature TW1 and calculate the first temperature difference by the formula: T1=TP1−TW1; where, T1 is the first temperature difference.

S123: after the air conditioner operates for the second duration in the first state, obtain the second heat exchanger temperature and the second ambient temperature and calculate the second temperature difference between the second heat exchanger temperature and the second ambient temperature; the first preset condition is that the difference between the first temperature difference and the second temperature difference is not less than the preset temperature difference.

The second duration may be any reasonable time value greater than the first duration. Calculate the second temperature difference by the formula: T2=TP2−TW2; where, T2 is the second temperature difference, TP2 is the second heat exchanger temperature, and TW2 is the second ambient temperature. Calculate the difference between the first temperature difference and the second temperature difference (T2−T1). When the calculated difference is greater than or equal to the preset temperature difference, meet the first preset condition. The preset temperature difference may be a reasonable value greater than or equal to zero. In an embodiment, the preset temperature difference ranges from 8° C. to 18° C., such as 8° C., 11° C. and 18° C. The preset temperature difference may be adjusted based on the ambient temperature and the work power of the air conditioner. There is no specific limitation herein.

If the heat exchanger temperature and the ambient temperature meet the first preset condition, the four-way valve is normal in direction change and the air conditioner can defrost normally. It can be understood that before the four-way valve changes the direction, there is low-temperature and low-pressure refrigerant in the outdoor heat exchanger; when the four-way valve is normal in direction change, the high-temperature and high-pressure refrigerant from the compressor firstly flows through the outdoor heat exchanger; the outdoor heat exchanger temperature will gradually rise; the difference between the outdoor heat exchanger temperature and the ambient temperature will continue to increase. If the difference between the second temperature difference in the second duration and the first temperature difference in the first duration is not less than the preset temperature difference, it can be determined that the four-way valve is normal in direction change and the air conditioner can defrost normally. If don't meet the first preset condition, execute S13 to further detect whether the four-way valve is abnormal in direction change.

In some embodiments, obtain the outdoor heat exchanger temperature and the outdoor ambient temperature and determine whether the heat exchanger temperature and the ambient temperature meet the first preset condition. In some other embodiments, obtain the indoor heat exchanger temperature and the indoor ambient temperature and determine whether the indoor heat exchanger temperature and the indoor ambient temperature meet the first preset condition based on the difference of change in the indoor heat exchanger temperature and the indoor ambient temperature.

S13: obtain the work power of the air conditioner and determine whether the work power meets the second preset condition.

Where, if it's met, execute S1301; if it's not met, execute S1302.

S1301: the four-way valve is abnormal in direction change.

S1302: the four-way valve is normal in direction change.

When the heat exchanger temperature and the ambient temperature don't meet the first preset condition, the four-way valve may be normal or abnormal in direction change. For example, when the difference between the heat exchanger temperature which becomes stable and the ambient temperature in a cooling mode is small, it is difficult to detect whether the four-way valve is abnormal in direction change only based on the heat exchanger temperature and the ambient temperature. To make the detection more accurate, when the heat exchanger temperature and the ambient temperature don't meet the first preset condition, further detect whether the four-way valve is abnormal in direction change based on the work power of the air conditioner.

If the four-way valve is normal in direction change, the air conditioner defrosts in a cooling mode, and the air conditioner has normal rated power Pe in this state. In some embodiments, the second preset condition is that the difference between the work power and the normal rated power is greater than the preset value, where, the normal rated power is the power when the four-way valve is normal in direction change. When the difference between the work power Ps and the normal rated power Pe of the air conditioner is greater than the preset value, the work power meets the second preset condition and the four-way valve is abnormal in direction change. When the difference between the work power Ps and the normal rated power Pe of the air conditioner is less than the preset value, the work power doesn't meet the second preset condition, the four-way valve is normal in direction change, and the air conditioner can defrost normally. Where, the preset value may be zero or any reasonable numerical value. In an optimal embodiment, the preset value ranges from 15% to 25% of the normal rated power. For example, the preset value may be 15%, 18%, 23% and 25% of the normal rated power. There is no specific limitation herein.

Figure 5:
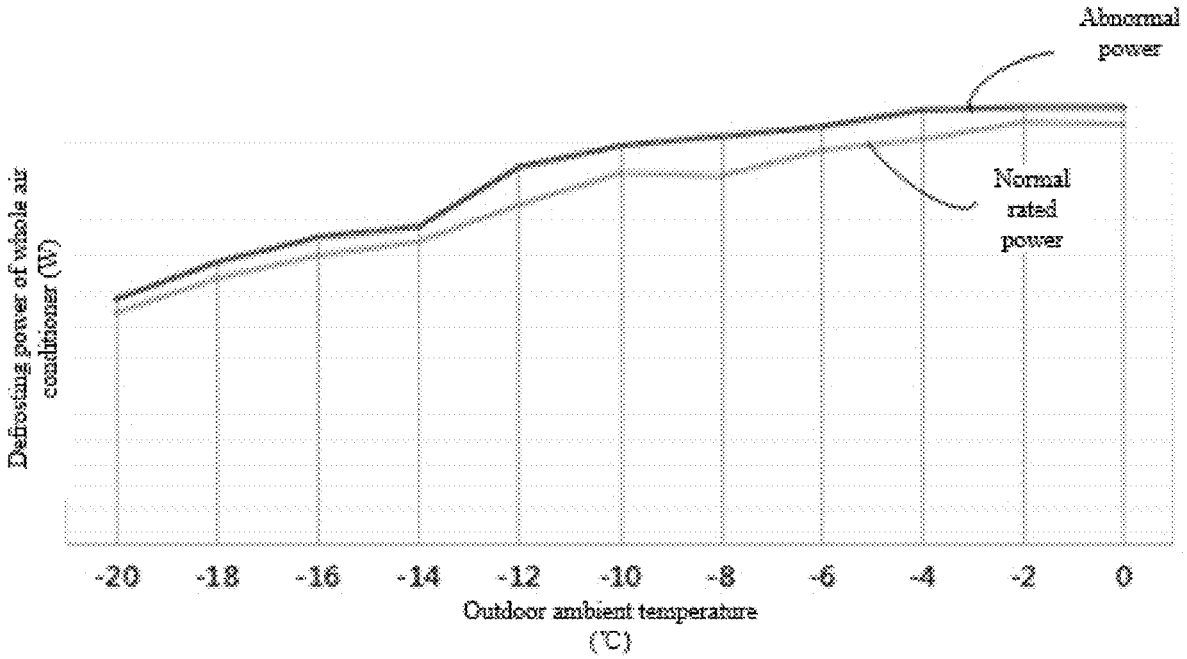
FIG. 5 illustrates a line chart of comparing the work power when the four-way valve is abnormal in direction change in defrosting with the normal rated power when the four-way valve is normal in direction change in defrosting.

Referring to FIG. 5, FIG. 5 illustrates a line chart of comparing the work power when the four-way valve is abnormal in direction change in defrosting with the normal rated power when the four-way valve is normal in direction change in defrosting. When the four-way valve is abnormal in direction change, the four-way valve cannot switch the flow direction of the refrigerant correctly. Therefore, the refrigerant cannot circulate correctly in the system. The efficiency of the air conditioner reduces. The air conditioner needs more electricity to reach the set temperature. Therefore, as shown in FIG. 5, at different outdoor ambient temperatures, the abnormal power when the four-way valve is abnormal in direction change will be greater than the normal rated power when the four-way valve is normal in direction change. In addition, the difference between the abnormal power and the normal rated power is greater than the preset value which is related to the outdoor ambient temperature. Besides, the preset value ranges from 15% to 25% of the normal rated power. When the difference between the work power and the normal rated power is greater than the preset value, the four-way valve is abnormal in direction change. When the difference between the work power and the normal rated power is not greater than the preset value, the four-way valve is normal in direction change.

Different from the related art, the embodiments of this application relate to a four-way valve abnormal direction change detection method. The method detects and determines whether the four-way valve is abnormal in direction change by change rate of the heat exchanger temperature and the ambient temperature and power comparison to the detection more accurate. When the four-way valve is abnormal in direction change, handle it in time so as to improve the probability of successful direction change of the four-way valve and the successful rate of defrosting.

Figure 6:
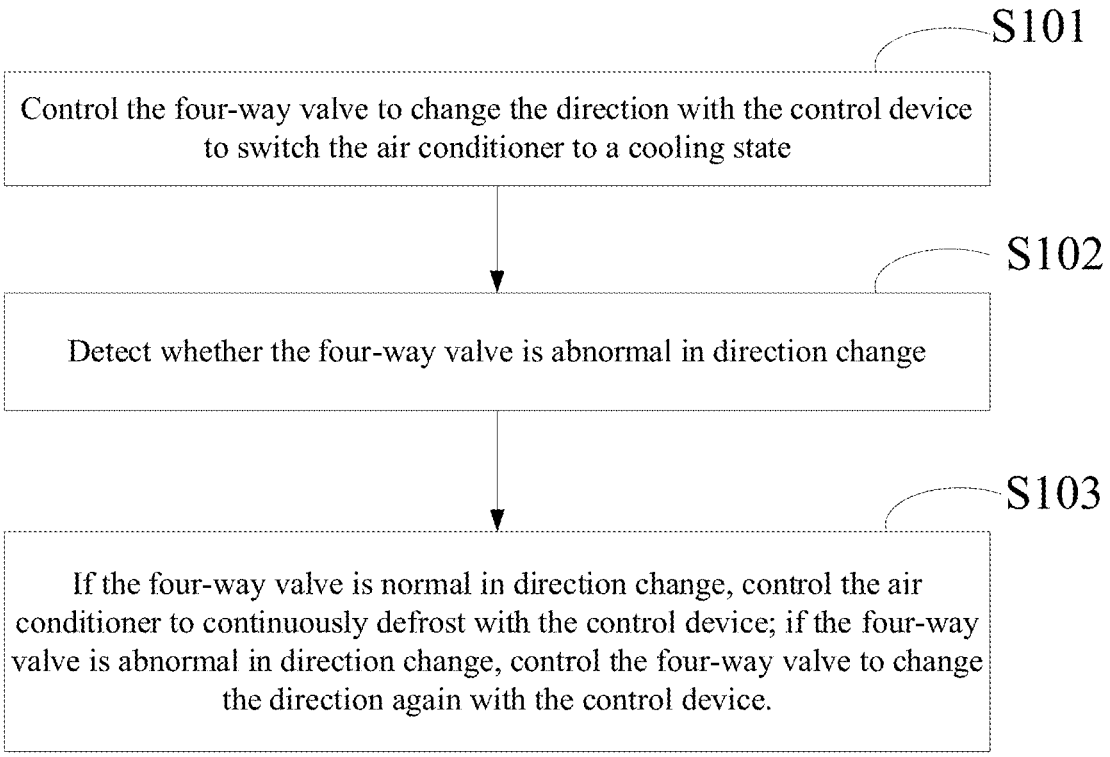
FIG. 6 illustrates a flowchart of the defrosting control method of the air conditioner, according to some implementations of the present disclosure.

In some embodiments, this application also relates to a defrosting control method of the air conditioner. This method applies the four-way valve abnormal direction change detection method mentioned in above embodiments. Referring to FIG. 6, FIG. 6 illustrates a flowchart of the defrosting control method of the air conditioner, according to some implementations of the present disclosure. In an embodiment, the defrosting control method includes that:

S101: control the four-way valve to change the direction with a control device to switch the air conditioner to a cooling state.

In a heating mode, the high-temperature and high-pressure gaseous refrigerant produced in the compressor firstly flows to the indoor heat exchanger. There is the low-temperature and low-pressure gaseous refrigerant in the outdoor heat exchanger. Therefore, in a heating mode, the outdoor heat exchanger is prone to frosting. Where, the four-way valve changes the direction to switch the cooling state of the air conditioner to the heating state. In the cooling state, the high-temperature and high-pressure gaseous refrigerant produced in the compressor firstly flows to the outdoor heat exchanger to defrost the outdoor heat exchanger.

S102: detect whether the four-way valve is abnormal in direction change.

Where, the detection method is the four-way valve abnormal direction change detection method mentioned in any above embodiments. This method detects and determines whether the four-way valve is abnormal in direction change by change rate of the heat exchanger temperature and the ambient temperature and power comparison to make the detection more accurate.

S103: if the four-way valve is normal in direction change, control the air conditioner to continuously defrost with the control device; if the four-way valve is abnormal in direction change, control the four-way valve to change the direction again with the control device.

Where, the control device is a control center of the air conditioner and can control the connection state of the four-way valve to control the state of the air conditioner. For example, control the air conditioner in a heating state, a cooling state, an air supply state, a standby state, etc. Control the air conditioner in a cooling state with the control device to control the air conditioner to continuously defrost. In some embodiments, the control device may be an integrated circuit chip with signal processing capability. In some other embodiments, the control device may also be an general-purpose processor, a digital signal processor, a dedicated integrated circuit and one of other devices capable of receiving and processing signals and generating corresponding control electrical signals. There is no specific limitation herein.

In some embodiments, during defrosting of the air conditioner, detect and determine whether the four-way valve is abnormal in direction change by change rate of the heat exchanger temperature and the ambient temperature and power comparison. When the four-way valve is abnormal in direction change, the control device controls the four-way valve to change the direction again so as to improve the probability of successful direction change of the four-way valve and the successful rate of defrosting.

Figure 7:
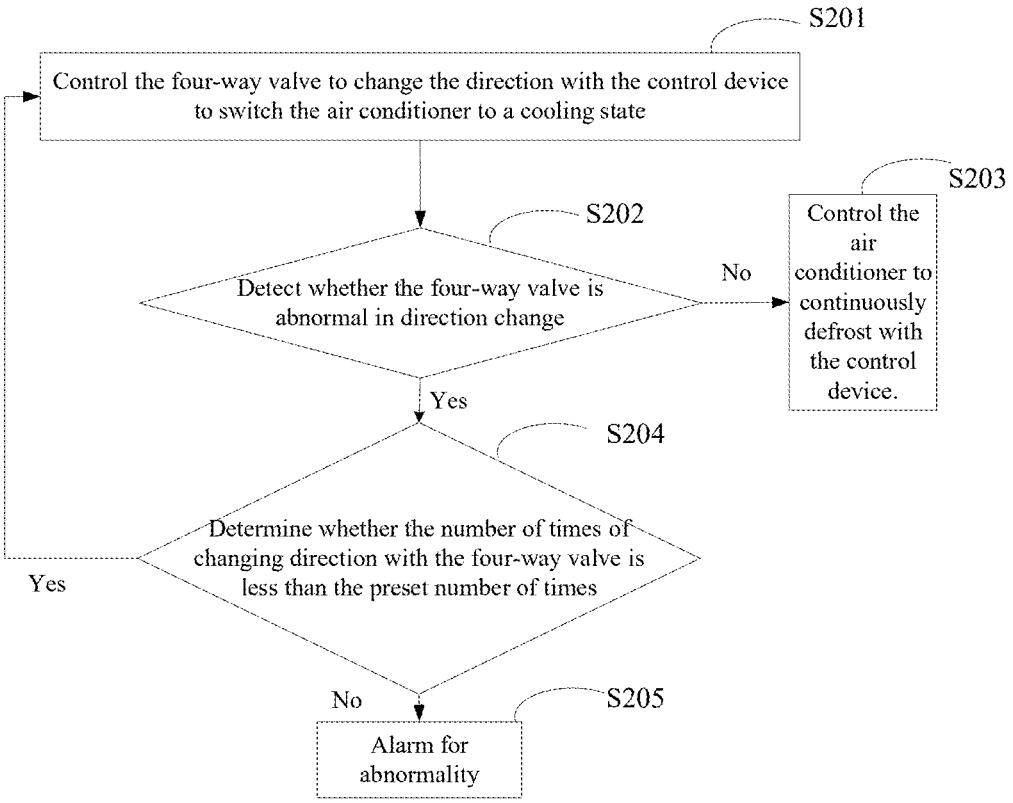
FIG. 7 illustrates a flow diagram of the defrosting control method of the air conditioner, according to some implementations of the present disclosure.

Referring to FIG. 7, FIG. 7 illustrates a flow diagram of the defrosting control method of the air conditioner, according to some implementations of the present disclosure. In another embodiment, the defrosting control method includes that:

S201: control the four-way valve to change the direction with the control device to switch the air conditioner to a cooling state.

S202: detect whether the four-way valve is abnormal in direction change.

If the four-way valve is normal in direction change, execute S203; if the four-way valve is abnormal in direction change, execute S204.

The detection method is described in above embodiments. There is no specific limitation herein. Where, when determining whether the heat exchanger temperature and the ambient temperature meet the first preset condition, obtain the outdoor heat exchanger temperature and the outdoor ambient temperature and determine whether the outdoor heat exchanger temperature and the outdoor ambient temperature meet the first preset condition. Refer to S101 and S102 for S201 and S202 in details. No further description is made herein.

S203: control the air conditioner to continuously defrost with the control device.

S204: determine whether the number of times of changing direction with the four-way valve is less than the preset number of times.

If the number of times of changing direction with the four-way valve is less than the preset number of times, execute S201; if the number of times of changing direction with the four-way valve is not less than the preset number of times, execute S205.

In some embodiments, when the four-way valve is abnormal in direction change, the control device controls the four-way valve to change the direction repeatedly, increasing number of times of changing direction with the four-way valve, and thereby increasing the probability of successful direction change of the four-way valve. In some embodiments, the preset number of times is 3. In some other embodiments, the preset number of times may also be 4, 5 or other reasonable number. There is no specific limitation herein.

S205: alarm for abnormality.

If the four-way valve is still abnormal in direction change after switching a plurality of times, the control device will control to alarm for abnormality to remind users to repair or replace.

Some embodiments of this application also relate to an air conditioner. The air conditioner controls defrosting by defrosting control method mentioned in above embodiments.

Where, the air conditioner includes the compressor, the indoor heat exchanger, the outdoor heat exchanger, the four-way valve and the throttle valve; the compressor includes the air outlet and the air inlet; the four-way valve includes the first flow channel and the second flow channel; the four-way valve is configured to switch the connection state to ensure that in a heating mode, the air outlet of the compressor, the first flow channel (indoor heat exchanger flow channel) of the four-way valve, the indoor heat exchanger, the throttle valve, the outdoor heat exchanger, the second flow channel (the outdoor heat exchanger flow channel) of the four-way valve and the air inlet of the compressor are connected in sequence to form a heating loop; in a cooling mode, the air outlet of the compressor, the second flow channel of the four-way valve, the outdoor heat exchanger, the throttle valve, the indoor heat exchanger, the first flow channel of the four-way valve, and the air inlet of the compressor are connected in sequence to form a cooling loop.

The above content is only the embodiments of this application and constitutes no limitation to the scope of the disclosure in this application. Any equivalent structure or equivalent process transformation made by reference of the specification and the drawings in this application, or direct or indirect application in other related technical fields are included in the protection scope of the disclosure of this application.

What is claimed is:

1. A four-way valve abnormal direction change detection method, comprising:

obtaining a heat exchanger temperature and an ambient temperature;

determining whether the heat exchanger temperature and the ambient temperature meet a first preset condition;

when the heat exchanger temperature and the ambient temperature meet the first preset condition, the four-way valve is determined to be normal in direction change;

when the heat exchanger temperature and the ambient temperature do not meet the first preset condition, obtaining work power of the air conditioner and determining whether the work power meets a second preset condition; and when the work power meets the second preset condition, the four-way valve is determined to be abnormal in direction change; otherwise, the four-way valve is determined to be normal in direction change.

2. The four-way valve abnormal direction change detection method according to claim 1, wherein, the obtaining the heat exchanger temperature and the ambient temperature and determining whether the heat exchanger temperature and the ambient temperature meet the first preset condition comprises:

controlling, via a control device, the air conditioner in a first state;

after the air conditioner operates for a first duration in the first state, obtaining a first heat exchanger temperature and a first ambient temperature and calculating a first temperature difference between the first heat exchanger temperature and the first ambient temperature; and after the air conditioner operates for a second duration in the first state, obtaining a second heat exchanger temperature and a second ambient temperature and calculating a second temperature difference between the second heat exchanger temperature and the second ambient temperature, wherein the first preset condition is that a difference between the first temperature difference and the second temperature difference is not less than a preset temperature difference.

3. The four-way valve abnormal direction change detection method according to claim 1, wherein, the obtaining the heat exchanger temperature and the ambient temperature comprises at least one of the following:

obtaining an outdoor heat exchanger temperature and an outdoor ambient temperature; or obtaining an indoor heat exchanger temperature and an indoor ambient temperature.

4. The four-way valve abnormal direction change detection method according to claim 2, wherein, the determining whether the work power meets the second preset condition comprises:

the second preset condition is that a difference between the work power and a normal rated power is greater than a preset value, wherein the normal rated power is the power when the four-way valve is normal in direction change.

5. The four-way valve abnormal direction change detection method according to claim 4, wherein, the preset temperature difference ranges from 8° C. to 18° C.; or the preset value ranges from 15% to 25% of the normal rated power.

6. A defrosting control method for an air conditioner, comprising:

controlling, via a control device, a four-way valve to change a direction to switch the air conditioner to a cooling state;

detecting whether the four-way valve is abnormal in direction change by:

obtaining a heat exchanger temperature and an ambient temperature;

determining whether the heat exchanger temperature and the ambient temperature meet a first preset condition;

when the heat exchanger temperature and the ambient temperature meet the first preset condition, the four-way valve is determined to be normal in direction change;

when the heat exchanger temperature and the ambient temperature do not meet the first preset condition, obtaining work power of the air conditioner and determining whether the work power meets a second preset condition; and when the work power meets the second preset condition, the four-way valve is determined to be abnormal in direction change; otherwise, the four-way valve is determined to be normal in direction change;

when the four-way valve is normal in direction change, controlling, via the control device, the air conditioner to continuously defrost; and when the four-way valve is abnormal in direction change, execute the controlling, via the control device, the four-way valve to change the direction to switch the air conditioner to the cooling state.

7. The defrosting control method according to claim 6, wherein when the four-way valve is abnormal in direction change, the controlling, via the control device, the four-way valve to change the direction to switch the air conditioner to the cooling state comprises:

when the four-way valve is abnormal in direction change, determine whether a number of times of changing direction with the four-way valve is less than a preset number of times;

when the number of times of changing direction with the four-way valve is less than the preset number of times, execute the controlling, via the control device, the four-way valve to change the direction to switch the air conditioner to the cooling state; otherwise, generating an alarm notifying users to perform repair or replacement.

8. The defrosting control method according to claim 7, wherein the preset number of times is 3.

9. An air conditioner, comprising:

a four-way valve; and a control device coupled to the four-way valve, wherein the control device is configured to perform operations comprising:

obtaining a heat exchanger temperature and an ambient temperature;

determining whether the heat exchanger temperature and the ambient temperature meet a first preset condition;

when the heat exchanger temperature and the ambient temperature meet the first preset condition, the four-way valve is determined to be normal in direction change;

when the heat exchanger temperature and the ambient temperature do not meet the first preset condition, obtaining work power of the air conditioner and determining whether the work power meets a second preset condition; and when the work power meets the second preset condition, the four-way valve is determined to be abnormal in direction change; otherwise, the four-way valve is determined to be normal in direction change.

10. The air conditioner according to claim 9, further comprising:

a compressor;

an indoor heat exchanger;

an outdoor heat exchanger; and a throttle valve, wherein:

the compressor comprises an air outlet and an air inlet;

the four-way valve comprises a first flow channel and a second flow channel;

the four-way valve is configured to switch the connection state to ensure at least one of the following:

in a heating mode, the air outlet of the compressor, the first flow channel of the four-way valve, the indoor heat exchanger, the throttle valve, the outdoor heat exchanger, the second flow channel of the four-way valve, and the air inlet of the compressor are connected in sequence to form a heating loop; or in a cooling mode, the air outlet of the compressor, the second flow channel of the four-way valve, the outdoor heat exchanger, the throttle valve, the indoor heat exchanger, the first flow channel of the four-way valve, and the air inlet of the compressor are connected in sequence to form a cooling loop.

* * * * *